US006270194B1

(12) United States Patent
Maximovsky et al.

(10) Patent No.: US 6,270,194 B1
(45) Date of Patent: Aug. 7, 2001

(54) PRINTING METHOD AND PRINTING DEVICE FOR REALIZING THE SAME

(76) Inventors: Sergei Nikolaevich Maximovsky, ul. Skakovaya,d. 34, korp. 4, kv. 235; Grigory Avramovich Radutsky, ul. Pervomaiskaya, d. 66, kv. 45, both of Moscow (RU)

( * ) Notice: Subject to any disclaimer, the term of this patent is extended or adjusted under 35 U.S.C. 154(b) by 0 days.

(21) Appl. No.: 09/125,357

(22) PCT Filed: Jan. 31, 1997

(86) PCT No.: PCT/RU97/00015

§ 371 Date: Aug. 17, 1998

§ 102(e) Date: Aug. 17, 1998

(87) PCT Pub. No.: WO97/29913

PCT Pub. Date: Aug. 21, 1997

(30) Foreign Application Priority Data

Feb. 19, 1996 (RU) ..... 96102666

(51) Int. Cl.[7] ..... B41J 2/04
(52) U.S. Cl. ..... 347/51
(58) Field of Search ..... 347/51, 50.16, 347/52–55

(56) References Cited

U.S. PATENT DOCUMENTS

| | | | | |
|---|---|---|---|---|
| 3,502,022 | | 3/1970 | Wood | 101/129 |
| 4,117,497 | * | 9/1978 | McGroddy et al. | 347/51 |
| 4,312,009 | * | 1/1982 | Lange | 347/51 |
| 5,021,808 | * | 6/1991 | Kohyama | 347/51 |
| 5,666,598 | * | 9/1997 | Sugita et al. | 347/51 |
| 5,992,977 | * | 11/1999 | Horinaka et al. | 347/51 |
| 6,056,388 | * | 5/2000 | Maximovsky et al. | 347/51 |

FOREIGN PATENT DOCUMENTS

| | | | | |
|---|---|---|---|---|
| 0421718 | | 4/1991 | (EP) . | |
| 0488113 | | 6/1992 | (EP) . | |
| 0495623 | | 7/1992 | (EP) . | |
| 823328 | * | 2/1998 | (EP) . | |
| 947324 | * | 10/1999 | (EP) . | |
| 180352 | * | 7/1989 | (JP) | 347/51 |
| 187758 | * | 8/1991 | (JP) | 347/51 |
| 1416333 | | 8/1988 | (RU) . | |
| 987647 | * | 1/1983 | (SU) . | |
| 96/33071 | * | 10/1996 | (WO) . | |
| 97/00774 | * | 1/1997 | (WO) . | |

* cited by examiner

*Primary Examiner*—Stephen R. Funk
(74) *Attorney, Agent, or Firm*—Ostrolenk, Faber, Gerb & Soffen, LLP

(57) ABSTRACT

The method for printing is carried out by creating pressure pulses at individual points of an ink layer which has been applied onto the surface of a continuous smooth plate, focusing a light beam of a laser on those points from the side of the opposite surface of the plate. Pressure pulses are developed due to the light hydraulic effect at the border of the surface of a plate, made of transparent material, and a layer of ink applied thereon, or due to the conversion of light radiation into acoustic when the light beam of the laser is absorbed by material which is not transparent for its wavelength. The printer has a device for deflecting the light beam over the surface of the plate to excite pressure pulses in the ink layer at points predetermined by a program.

9 Claims, 2 Drawing Sheets

PRINTING METHOD AND PRINTING DEVICE FOR REALIZING THE SAME

FIELD OF THE INVENTION

The present invention relates to printers. More specifically, the invention relates to means for printing both very simple and highly artistic printed matter on different types of carriers.

BACKGROUND ART

A method for printing is known which consists of placing a carrier before a printing plate, applying a layer of ink onto the surface of the plate, and selectively transferring ink from predetermined points on the surface of the plate to the carrier. In the known method taught in Japanese application No. 55-34970, class B 41 M 1/12, published Mar. 11, 1980, under number No. 53-108988, a layer of ink is applied onto a printing plate having the form of a grid with a combination of apertures which forms the image to be reproduced, and the ink is forced through the apertures onto the carrier.

A disadvantage of this method is that it is necessary to make a new plate with another combination of apertures for the passage of ink in order to print each new image. This process is not only lengthy in itself but is related to substantial expenditures due to manufacture of the plate.

In order to carry out the known method for printing, a device is used which is also taught in the cited patent. This device comprises a printing plate, means for applying a layer of ink onto the surface of the plate and means for transferring the ink from the plate onto a carrier. The printing plate is made in the form of a grid covered with a layer of light sensitive emulsion, which upon exposition through a photoform under the effect of UV-radiation is hardened on the portions of the spaces which are to be filled. The nonhardened portions of the emulsion are washed off. The hardened emulsion is subjected to thermal treatment for hardening and is covered with a special composition for protection from acids and alkalis. In the process of printing, ink is applied to the plate and then, using a squeegee, is pressed through the open cells of the grid and transferred to the carrier. After the printing is completed, the hardened layer is removed from the grid which is once again covered with light sensitive emulsion to make a new plate.

A disadvantage of such devices is the necessity of making and mounting new plates to print each edition. This process is lengthy in itself. The present-day situation in polygraphy is characterized by small editions, as a result of which the time for preparation of a machine for operation becomes comparable with the printing time itself, i.e. expensive equipment is not used efficiently.

DISCLOSURE OF THE INVENTION

At the base of the invention lies the problem of creating such a method and printer for printing which would eliminate the making and mounting of plates to print each edition, would reduce the time for preparation of the printing and would make it possible to effectively use the printing equipment.

This problem is solved in a method for printing which consists of placing a carrier before a printing plate, applying a layer of ink onto the surface of the plate and selectively transferring the ink from predetermined points on the surface of the plate to the carrier, in that in accordance with the invention, the surface of the plate is made continuous and smooth, the layer of ink is applied onto the surface facing the carrier, and from the side of the opposite surface a light beam from a laser (quantum oscillator) is focused on those points of the layer of ink which are transferred to the carrier.

With such a method for printing, there is no necessity to change the plate for each image being reproduced, since the light beam of the laser at any given point creates an impact pulse in the layer of ink and ejects a drop thereof onto the carrier.

It is advisable that the plate be made from a material which is transparent for the wavelength of the laser.

Such a realization of the method makes it possible to effectively use the beam energy.

It is advisable that a plurality of insulated areas of a material which is not transparent for the wavelength radiated by the laser be formed on the surface of the plate facing the carrier, and that they be arranged in the form of two groups of mutually intersecting parallel rows, comprising a matrix.

Such a realization of the method makes it possible to create an impact pulse in the layer of ink and eject drops even in the case where the light beam of the laser will not be absorbed in that layer, since in that case an acoustic pulse will be excited upon interaction of the light beam of the laser with material which is not transparent for its wavelength, i.e. conversion of light energy into acoustic will occur.

It is advisable that the insulated areas on the surface of the plate be arranged with a spacing between them which corresponds to a predetermined resolution of the image to be reproduced.

Such a realization of the method makes it possible to reproduce highly artistic images, the distance between adjacent ink points of which is small and tends to the theoretically possible.

It is advisable that the insulated areas on the surface of the plate be made from a material radiating acoustic pulses when light beam pulses from the laser impinge thereon.

Such a realization of the method makes it possible to create impact pulses in layers of ink of different colors, thus ensuring the possibility for color printing.

It is advisable that metal films, semiconductor films or supergrids with quantum pits be used as the material of the isolated areas.

Such a realization of the method makes it possible to convert the light beam energy of the laser into acoustic energy in the most effective manner.

It is also advisable that an electrode be mounted in the zone in which the carrier is positioned, and that voltage be applied between the electrode and the ink layer on the surface of the plate.

Such a realization of the method makes it possible to transfer particles of ink charged at the point of interaction of the beam and the ink layer to the carrier due to an electrostatic field, and this makes it possible to reduce the power of coherent radiation.

The stated problem is also solved in that in a printer comprising a printing plate, means for applying a layer of ink onto the plate and means for transferring the ink from the plate onto a carrier, in accordance with the invention, the surfaces of the plate are made continuous and smooth, the means for applying a layer of ink onto the plate is made with the possibility of applying ink onto its surface facing the carrier, and the means for transferring the ink from the plate onto the carrier is made in the form of a light beam laser with a device for focusing the beam on predetermined points of the ink layer from the surface side of the plate opposite to that facing the carrier, and with a device for deflecting the beam over the surface of the plate.

Such a realization of the device makes it possible to reduce the time of its preparation for operation, excluding therefrom the time for making and mounting the plates.

It is advisable that the plate be made of electrically nonconductive material which is transparent for the wavelength radiated by the laser.

Such a realization of the device makes it possible to ensure transfer of drops of ink from the plate onto the carrier with minimum power consumption.

It is advisable that areas of a material which is not transparent for the wavelength radiated by the laser be made on the surface of the plate facing the carrier, the areas being arranged in the form of two groups of mutually intersecting rows forming a matrix with a spacing between the areas corresponding to a predetermined resolution of the image to be reproduced.

Such a realization of the device makes it possible to carry out color printing with high resolution.

It is advisable that the insulated areas on the surface of the plate be made from a material radiating acoustic pulses when light beam pulses of the laser impinge thereon, for example, from a metal film, semiconductor film, or supergrid with quantum pits.

Such a realization of the device makes it possible to use a low-power laser.

It is also advisable that the printer comprise a voltage source connected to two electrodes, one of which is mounted above the printing plate in the zone in which the carrier is positioned, the other is secured to the plate and in contact with the ink layer.

Such a realization of the device makes it possible to reduce the power of the laser.

BRIEF DESCRIPTION OF THE DRAWINGS

The invention will further be explained by a description of concrete, but not limiting, embodiments of the present invention and by the accompanying drawings, wherein.

BEST METHODS OF CARRYING OUT THE INVENTION

The proposed method is carried out in the following manner.

Figure 1:
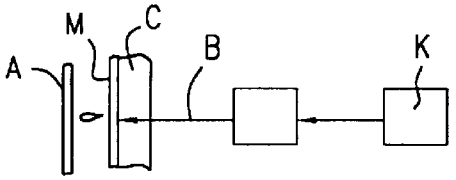
FIG. 1 illustrates the proposed method for printing with interaction of the light beam of a laser with ink applied onto a plate which is transparent in respect of the wavelength of the light beam.

The surfaces of the plate C (FIG. 1) are made continuous and smooth. A layer of ink E is applied onto the plate surface facing a carrier D, and a light beam B of a laser K is focused from the side of the opposite surface. The carrier is placed before the surface of the plate is wetted with ink. When the plate C is made of a material which is transparent for the wavelength of the light beam B, an impact pulse is developed at the point at which the light beam impinges on the layer of ink due to the action of the light hydraulic effect (Discovery Diploma No. 65 BI No. 19, 1969).

Figure 2:
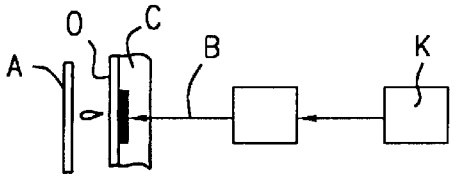
FIG. 2 shows the proposed method for printing with interaction of the light beam of a laser with the material of an area of the plate which is not transparent in respect of the wavelength of the light beam.

When an area O, made of a material which is not transparent for the wavelength of the light beam of the laser, is formed on the surface of the plate C (FIG. 2), the impingement of a light beam on that area causes the formation of an acoustic pulse, under the action of which a drop of ink breaks away from the ink layer and falls on the carrier D.

Figure 3:
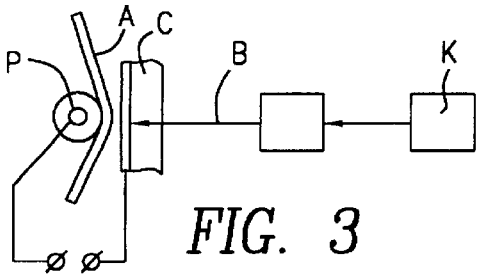
FIG. 3 shows the proposed method for printing with the simultaneous application of a voltage between an electrode in the zone in which the carrier is positioned and the ink layer on the surface of the plate and action on a point of the ink layer by the light beam of a laser.

When a voltage is applied between an electrode P (FIG. 3), which is mounted in the zone in which the carrier D is positioned, and the layer of ink on the surface of the plate C which is made of a material that is transparent for the wavelength of the light beam of the laser, the impact of the light beam on the layer of ink also results in the action of an electrostatic field, interacting with the particles of ink charged by the beam, on the drop torn off of that layer under the action of the light hydraulic effect.

Figure 4:
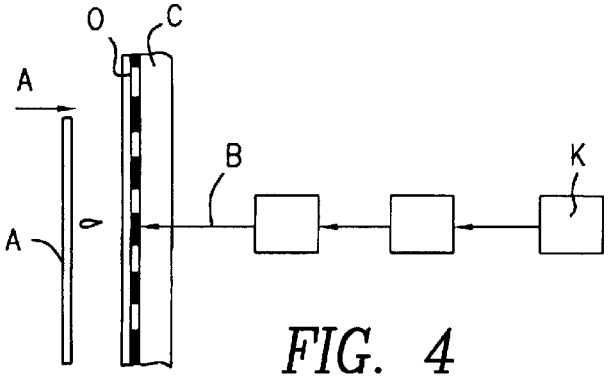
FIG. 4 shows the proposed method for printing when a matrix is formed on the surface of the plate, the matrix being made of areas of material which is not transparent in respect of the wavelength of the light beam of the laser.
Figure 5:
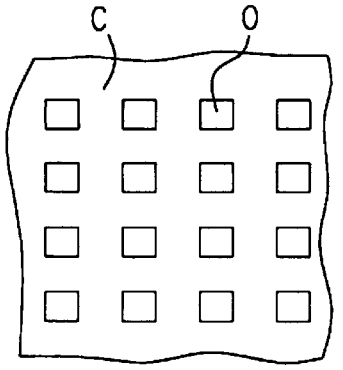
FIG. 5 is the same, a view along arrow A.

When a matrix of areas O are formed on the surface of the plate C (FIGS. 4 and 5) of a material that is not transparent for the wavelength of the light beam B of the laser K, the impingement of the light beam on any of those areas causes an acoustic pulse and the ejection of a drop from the ink layer onto the carrier D.

It is obvious from the foregoing description of the proposed method that with a continuous smooth plate it is possible to ensure the ejection of a drop of ink from the layer applied on the surface thereof, independent of the color of that ink.

Figure 6:
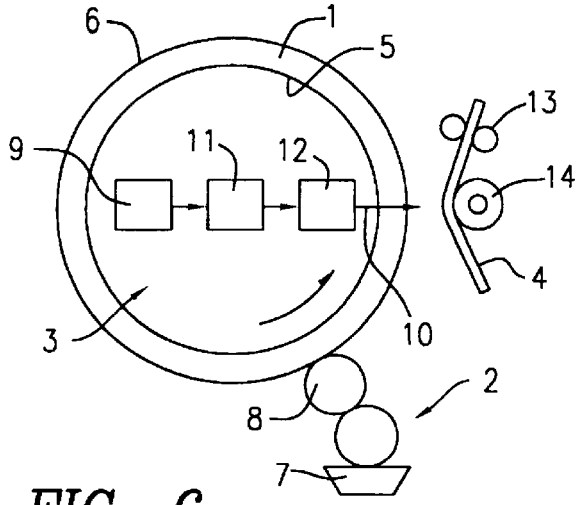
FIG. 6 is a general view of the proposed printer with an ink layer being applied onto a plate which is transparent in respect of the wavelength of the light beam of the laser.

In order to carry out the proposed method for printing, it is necessary to provide deflection of the light beam of the laser over the surface of the plate. This is carried out by means of a printer shown in FIGS. 6, 7 and 8.

The proposed printer (FIG. 6) comprises a printing plate 1, means 2 for applying a layer of ink onto the plate 1 and means 3 for transferring the ink from the plate 1 onto a carrier 4. The printing plate 1 is made in the form of a hollow cylinder with continuous smooth inner 5 and outer 6 surfaces. The means 2 for applying a layer of ink onto the plate comprises a pool 7 with ink and drive rollers 8 which feed ink from the pool onto the surface 6 of the plate. The means 3 for transferring ink from the plate 1 onto the carrier 4 comprises a laser 9 producing a light beam 10 with a device 11 for focusing it and with a device 12 for deflecting the beam over the surface 5 of the plate 1 that is made of a material which is transparent for the wavelength of that beam. The printing plate 1 is made to rotate by a drive (not shown in the drawing). A carrier 4 is moved relative to the plate 1 by a drive 13, going around a roller 14.

When ink is used which is transparent for the wavelength of the light beam of the laser, a matrix is formed on the surface 6 of the plate 1 (FIG. 7), the matrix being formed of insulated areas 15 of a material which is not transparent for the wavelength of the light beam 10 of the laser 9 and radiates acoustic pulses when that beam impinges thereon.

When an electrostatic field is used for further action on drops torn off the ink layer, the printer comprises a voltage source (FIG. 8) which is connected to two electrodes, one of which is the roller 14, the other, 17, is secured on the plate 1 and is in contact with the ink layer.

The proposed printer operates in the following manner.

When the plate 1 (FIG. 6) rotates, a layer of ink is applied onto its continuous smooth surface 6. The beam 10 of the laser 9 is directed through the material of the plate 1, which is transparent for the wavelength of the beam, is focused at a point of the surface of the ink layer adjacent the surface 6, and is deflected over the generatrix of the plate. In accordance with a predetermined program, the beam 10 interacts with the ink layer at certain points, causing the ejection of drops onto the carrier 4 from those points due to the light hydraulic effect, thus printing the image to be reproduced on the carrier.

Figure 7:
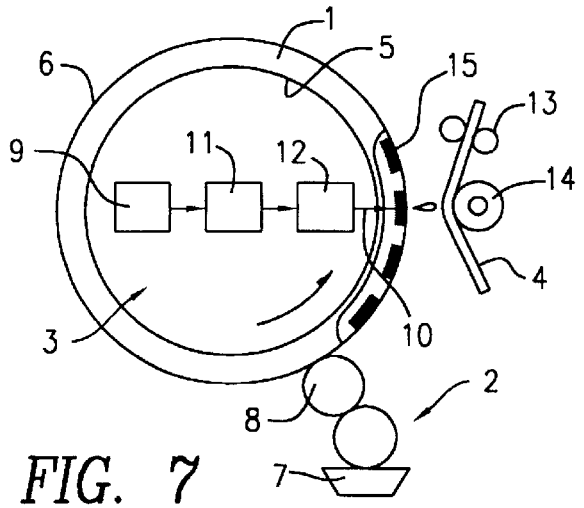
FIG. 7 is the same, when the ink layer is applied onto a plate, on the surface of which a matrix is formed of areas of a material which is not transparent for the wavelength of the light beam of the laser.
Figure 8:
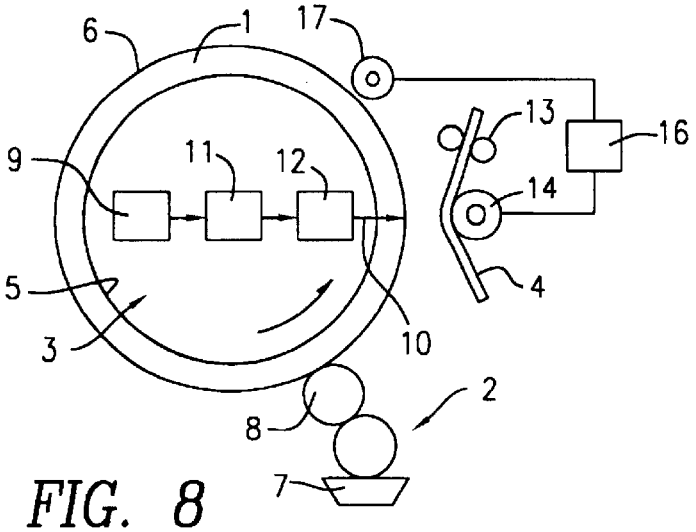
FIG. 8 is the same, when voltage is applied between an electrode in the zone in which the carrier is positioned and the ink layer on the surface of the plate, the material of which is transparent for the wavelength of the laser.

The printer operates in a similar manner in the case of use of a plate on the surface of which a matrix is formed of insulated areas which do not pass coherent radiation (FIG. 7). In that case the ejection of drops from the ink layer onto the carrier will take place due to acoustic pulses caused by absorption of the light beam by the material of the areas of the matrix.

Industrial Applicability

The printer serves to print various printing matter, including highly artistic polygraphic matter at high printing speeds.

What is claimed is:

1. A method for printing which comprises placing a carrier before a printing plate, applying a layer of ink onto the surface of the plate and selectively transferring the ink from predetermined points on the surface of the plate to the carrier, characterized in that the surface of the plate is continuous and smooth, the layer of ink is applied onto the surface facing the carrier, and from the side of the opposite surface a light beam from a laser is focused on the predetermined points of the layer of ink which are to be transferred onto the carrier so as to generate pressure pulses in the ink causing the ejection of a drop of the ink therefrom, wherein the printing plate is an electrically nonconductive material which is transparent for the wavelength radiated by the laser, and wherein a plurality of insulated areas of a material which is not transparent for the wavelength radiated by the laser are on the surface of the plate facing the carrier.

2. A method for printing according to claim 1, characterized in that the insulated areas are arranged relative to each other with a spacing between them which corresponds to a predetermined resolution of the image to be reproduced.

3. A method for printing according to claim 1, characterized in that the insulated areas are arranged in the form of two groups of mutually intersecting parallel rows, comprising a matrix.

4. A method for printing according to claim 3, characterized in that the insulated areas are arranged relative to each other with a spacing between them which corresponds to a predetermined resolution of the image to be reproduced.

5. A method for printing according to claim 3, characterized in that the insulated areas on the surface of the plate are made from a material radiating acoustic pulses when light beam pulses from the laser impinge thereon.

6. A method for printing according to claim 3, characterized in that the material of the insulated areas comprises metal films or semiconductors films.

7. A printer comprising a printing plate, a first applicator adapted to apply a layer of ink onto the plate and a second applicator adapted to transfer ink from the plate onto a carrier, characterized in that the surfaces of the plate are continuous and smooth, the first applicator is disposed so as to apply ink onto a plate surface facing the carrier, and the second applicator comprises a light beam laser, a laser light beam focuser adapted to focus the beam on predetermined points of the ink layer from the surface side of the plate opposite to that facing the carrier, and a deflector adapted to deflect the beam over the surface of the plate, wherein the printing plate is an electrically non-conductive material which is transparent for the wavelength radiated by the laser, and wherein the surface of the plate facing the carrier comprises a material having areas which are not transparent for the wavelength radiated by the laser.

8. A printer according to claim 7, characterized in that the areas being arranged in the form of two groups of mutually intersecting rows forming a matrix with a spacing between the areas corresponding to a predetermined resolution of the image being produced.

9. A printer according to claim 7, characterized in that the areas on the surface of the plate are of a material radiating acoustic pulses when light beam pulses from the laser impinge thereon.

* * * * *